US011383958B2

(12) United States Patent
Kwon

(10) Patent No.: US 11,383,958 B2
(45) Date of Patent: Jul. 12, 2022

(54) ELEVATOR COMPENSATION ROPE GUARD

(71) Applicant: OTIS ELEVATOR COMPANY, Farmington, CT (US)

(72) Inventor: KiSug Kwon, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 96 days.

(21) Appl. No.: 16/840,649

(22) Filed: Apr. 6, 2020

(65) Prior Publication Data

US 2021/0309493 A1 Oct. 7, 2021

(51) Int. Cl.

| | |
|---|---|
| ***B66B 15/02*** | (2006.01) |
| ***B66B 7/06*** | (2006.01) |
| ***B66B 9/00*** | (2006.01) |

(52) U.S. Cl.

CPC ..... *B66B 15/02* (2013.01); *B66B 7/068* (2013.01); *B66B 9/00* (2013.01)

(58) Field of Classification Search

CPC ..... B66B 7/068; B66B 15/02; B66B 15/04

See application file for complete search history.

(56) References Cited

U.S. PATENT DOCUMENTS 1,953,119 A * 4/1934 McCormick ..... B66B 7/068 187/265

FOREIGN PATENT DOCUMENTS

EP 2881354 A1 * 6/2015 ..... B66B 7/068
WO WO-2019180300 A1 * 9/2019 ..... B66B 15/04

* cited by examiner

*Primary Examiner* — Diem M Tran

(74) *Attorney, Agent, or Firm* — Carlson, Gaskey & Olds, P.C.

(57) ABSTRACT

An illustrative example embodiment of an elevator compensation assembly includes at least one compensation sheave having an outer surface configured to engage a plurality of compensation rope members. A guard has an inner surface situated adjacent the outer surface of the compensation sheave. A plurality of dividers that extend away from at least one of the outer surface of the compensation sheave or the inner surface of the guard. The dividers establish a space between adjacent ones of the dividers for accommodating a compensation rope member.

12 Claims, 2 Drawing Sheets

ELEVATOR COMPENSATION ROPE GUARD

BACKGROUND

Elevator systems are useful for carrying passengers and items between different levels of a building. Many elevator systems are traction-based and include traction ropes that suspends the elevator car and a counterweight. A machine causes movement of a traction sheave that, in turn, causes movement of the traction ropes for moving the elevator car as desired. One feature of traction-based elevator systems is a compensation assembly including compensation rope suspended beneath the car and counterweight and a tie down mechanism near the bottom of the hoistway. The compensation assembly facilitates maintaining appropriate tension on the traction ropes to achieve desired traction.

Some elevator systems are susceptible to rope sway. For example, in high rise buildings that may experience building sway, the hoist ropes and compensation ropes may sway laterally at high amplitudes. Compensation tie down sheaves typically include grooves that constrain the compensation ropes, however, under certain conditions such sway may result in one or several of the compensation ropes jumping out of or leaving its groove. A jumped compensation rope can become entangled with other compensation ropes during elevator car movement, which requires service by maintenance personnel.

SUMMARY

An illustrative example embodiment of an elevator compensation assembly includes at least one compensation sheave having an outer surface configured to engage a plurality of compensation rope members. A guard has an inner surface situated adjacent the outer surface of the compensation sheave. A plurality of dividers that extend away from at least one of the outer surface of the compensation sheave or the inner surface of the guard. The dividers establish a space between adjacent ones of the dividers for accommodating a compensation rope member.

In an example embodiment having at least one feature of the elevator compensation assembly of the previous paragraph, the dividers each comprise a flange on the outer surface of the at least one compensation sheave.

In an example embodiment having at least one feature of the elevator compensation assembly of any of the previous paragraphs, the dividers each comprise a rib on the inner surface of the guard.

In an example embodiment having at least one feature of the elevator compensation assembly of any of the previous paragraphs, the dividers each comprise a groove on the inner surface of the guard.

An example embodiment having at least one feature of the elevator compensation assembly of any of the previous paragraphs includes a plurality of compensation rope members received on the outer surface of the compensation sheave and the flanges extend from the outer surface of the compensation sheave a distance corresponding to at least one-half a thickness of the compensation rope members.

In an example embodiment having at least one feature of the elevator compensation assembly of any of the previous paragraphs, the dividers each comprise a rib on the inner surface of the guard.

In an example embodiment having at least one feature of the elevator compensation assembly of any of the previous paragraphs, the dividers each comprise a groove on the inner surface of the guard.

An illustrative example embodiment of an elevator system includes the compensation assembly of any of the previous paragraphs, an elevator car, a counterweight, and a plurality of compensation rope members coupled to the elevator car and the counterweight, the plurality of compensation rope members being respectively received in the spaces between the adjacent ones of the dividers.

In an embodiment having at least one feature of the system of the previous paragraph, the compensation sheave includes a plurality of grooves on an exterior of the compensation sheave and the compensation rope members are respectively received in the grooves.

An illustrative example embodiment of a method of controlling a position of elevator compensation rope members includes placing a compensation rope member within each of the spaces of the elevator compensation assembly of any of the previous paragraphs.

The various features and advantages of at least one disclosed example embodiment will become apparent to those skilled in the art from the following detailed description. The drawings that accompany the detailed description can be briefly described as follows.

DETAILED DESCRIPTION

Figure 1:
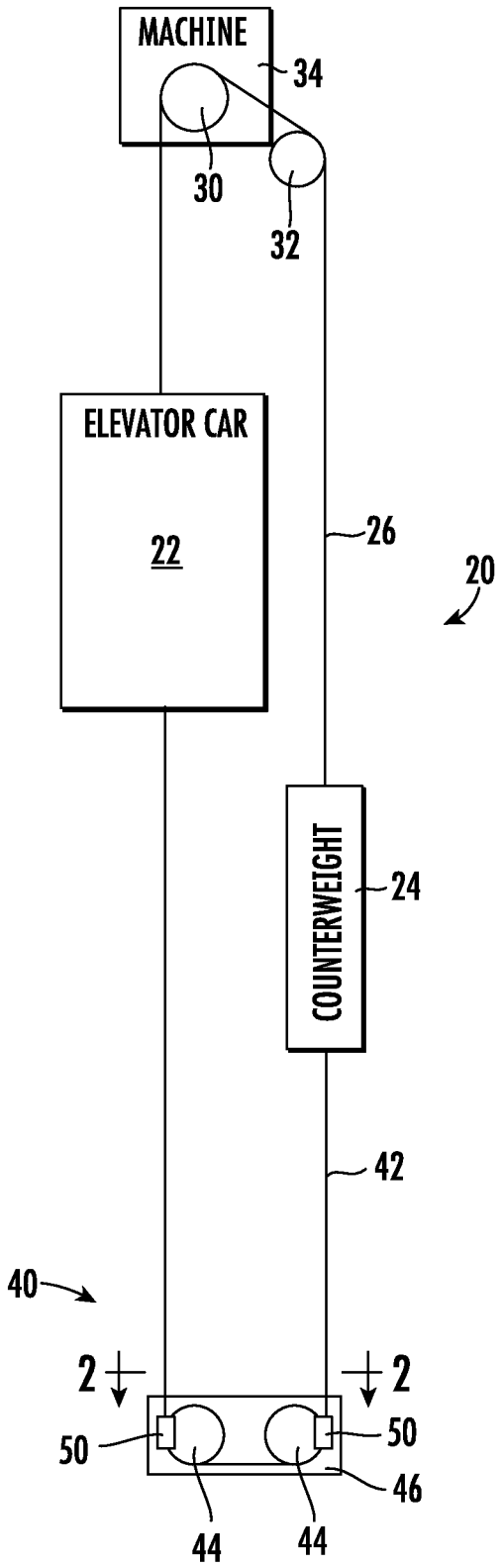
FIG. 1 schematically illustrates selected portions of an elevator system.

FIG. 1 schematically illustrates selected portions of an elevator system 20. An elevator car 22 is coupled to a counterweight 24 by traction ropes 26. Although not shown in detail, the traction ropes 26 include a plurality of tension members, such as round ropes or flat belts. The traction ropes 26 follows a path defined, at least in part, by sheaves 30 and 32. The sheave 30 is a traction sheave associated with a machine 34 that selectively causes movement of the traction ropes 26 to control the movement and position of the elevator car 22 for providing elevator service to passengers.

The elevator system 20 includes a compensation assembly 40 that facilitates maintaining adequate tension on the traction ropes 26 to achieve desired traction under a variety of elevator system conditions. The compensation assembly 40 include compensation rope members 42 suspended beneath the elevator car 22 and counterweight 24. The compensation rope members 42 follow a path defined, at least in part, by compensation sheaves 44, which are supported as part of a tie down mechanism 46. Guards 50 are situated to keep the compensation rope members 42 in position on the compensation sheaves 44.

Figure 2:
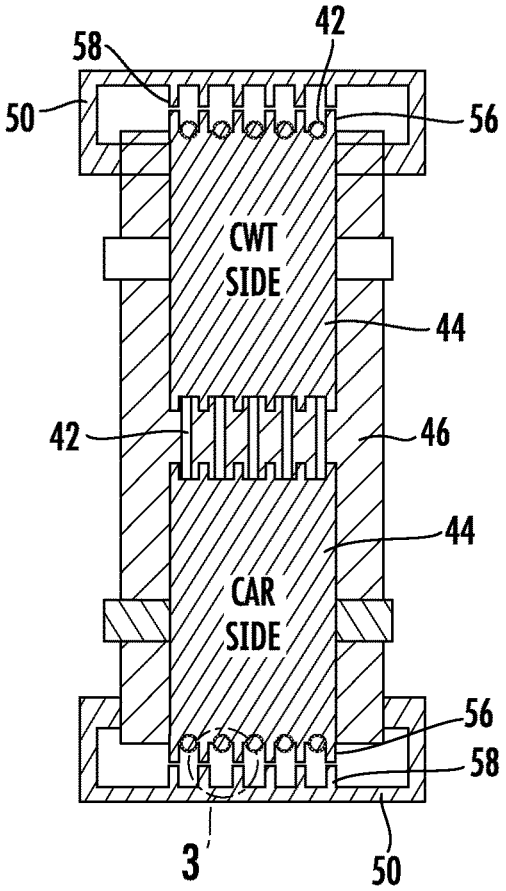
FIG. 2 is a cross-sectional illustration taken along the lines 2-2 in FIG. 1 showing selected portions of an example elevator compensation assembly.
Figure 3:
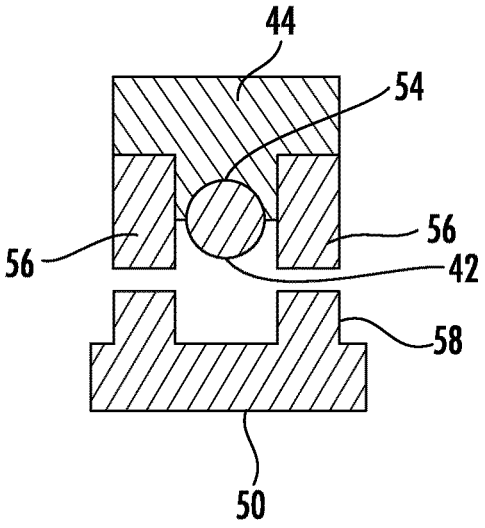
FIG. 3 is an enlarged view of the portion of FIG. 2 encircled at 3 schematically illustrating that portion of the example compensation rope guard configuration.

FIGS. 2 and 3 schematically illustrate selected portions of the example compensation assembly 40. In this example, the plurality of compensation rope members 42 are individual round ropes but other embodiments include chains or belts, for example. Each of the compensation rope members 42 is received within a corresponding groove 54 on each of the compensation sheaves 44. The predetermined position of each compensation rope 42 in this example embodiment includes the portion of the compensation rope 42 wrapped about each compensation sheave 44 being properly received within the corresponding one of the grooves 54.

The compensation sheaves 44 each include a plurality of flanges 56 adjacent the grooves 54. The flanges 56 are sheave dividers that divide the exterior of the compensation sheave 44 into a plurality of compensation rope member receiving spaces. The flanges 56 are distinct from the grooves 54 in that the compensation rope members 42 engage the grooves 54 but do not contact the flanges 56 under normal or expected elevator system operating conditions.

The flanges 56 provide a surface on each side of each of the compensation rope members 42 that extends radially away from an outer surface of the compensation sheave 44 to at least partially establish a containment space for each of the compensation rope members 42. In the illustrated example configuration, an outer edge of the flanges 56 is spaced from a center of the compensation sheave 44 further than a center of the roping member 42 is spaced from the center of the compensation sheave 44. In the illustrated example embodiment, the flanges 56 extend from the outer surface of the compensation sheave 44 along a radially oriented distance that is approximately equal to one half a thickness of the compensation rope members 42.

The guard 50 comprises a metal bracket or plate that remains stationary relative to the compensation sheave 44. The guard 50 includes a plurality of dividers 58 aligned with the flanges 56. Spacing between the outermost edges of the flanges 56 and the most interior edge of the dividers 58 allows for rotation of the compensation sheave 44 without any contact between the compensation sheave 44 and the guard 50.

The dividers 58 separate respective spaces for each of the compensation rope members 42. The dividers 58 and the flanges 56 cooperate to form a space within which the respective compensation rope member 42 is kept. The flanges 56 and the dividers 58 effectively separate the compensation rope members 42 and prevent unwanted contact or entanglement between them even under significant rope sway conditions within the elevator system 20.

In the example of FIG. 3, the dividers 58 comprises ribs or projections on the interior of the guard 50. The dividers may be formed together with the body or plate of the guard 50 or may be separate pieces that are secured in place onto the body of the guard 50.

Figure 4:
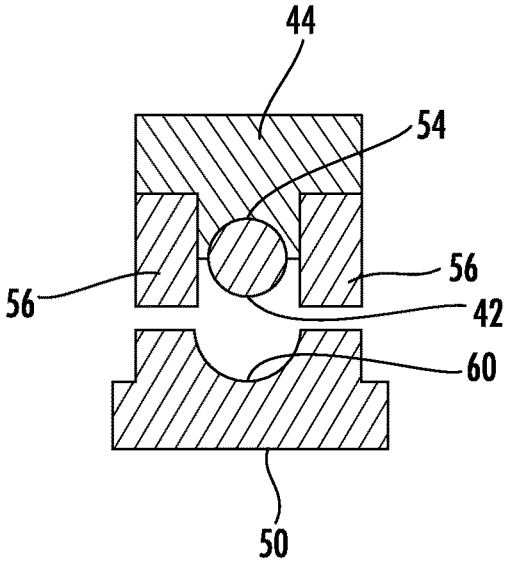
FIG. 4 schematically illustrates another example compensation rope guard configuration.

FIG. 4 shows another configuration of the guard 50. In this example, the interior surface of the guard 50 includes a groove 60 facing each of the grooves 54 on the compensation sheave 44. The groove 60 accommodates movement of the compensation rope member 42 out of the groove 54 and, together with the dividers or flanges 56, serves to prevent any contact between the compensation rope member 42 and an adjacent one of the compensation rope members.

The dividers or flanges 56 and the dividers 58 or grooves 60 establish a containment space that constrains undesired movement of a compensation rope member relative to the compensation sheave 44.

While separate dividers 56, 58 are provided on the compensation sheaves 44 and the guards 50, respectively in the example embodiments, others include dividers on only the sheaves 44 and still others include divider on only the guards 50. One benefit of including dividers on both the sheaves 44 and the guards 50 is that the dividers are not as long and, therefore, more structurally stable to resist deformation that might otherwise result from contact with an undesirably moving compensation rope member 42.

The illustrated and described example embodiments provide protection against compensation rope members 42 becoming entangled with each other by preventing the compensation rope members 42 from coming out of a corresponding groove 54 on a compensation sheave 44 and contacting another one of the compensation rope members 42. The illustrated example embodiments minimize or eliminate potential complications that may otherwise occur as a result of such compensation rope sway or other movement out of a predetermined position for the compensation rope members 42.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator compensation assembly, comprising:

a compensation sheave having an outer surface configured to engage a plurality of compensation rope members;

a guard having an inner surface situated adjacent and facing toward the outer surface of the compensation sheave; and a plurality of dividers that extend away from at least one of the outer surface of the compensation sheave or the inner surface of the guard, the dividers establishing a plurality of spaces between adjacent ones of the dividers for accommodating one of the plurality of compensation rope members in each of the plurality of spaces, wherein the plurality of compensation rope members do not contact the guard when the plurality of compensation rope members engage the outer surface of the compensation sheave, wherein the dividers each comprise at least one of a rib on the inner surface of the guard or a groove on the inner surface of the guard.

2. The elevator compensation assembly of claim 1, wherein the dividers each comprise a flange on the outer surface of the compensation sheave.

3. The elevator compensation assembly of claim 2, comprising the plurality of compensation rope members received on the outer surface of the compensation sheave and wherein the flanges extend from the outer surface of the compensation sheave a distance corresponding to at least one-half a thickness of the compensation rope members.

4. An elevator system, comprising the compensation assembly of claim 1, an elevator car, and a counterweight, wherein the plurality of compensation rope members are coupled to the elevator car and the counterweight.

5. The elevator system of claim 4, wherein the compensation sheave includes a plurality of grooves on the outer surface of the compensation sheave and the compensation rope members are respectively received in and engage the grooves.

6. The elevator system of claim 5, wherein the dividers each comprise a flange on the outer surface of the compensation sheave;

the flanges are distinct from the grooves; and the compensation rope members do not contact the flanges when the compensation rope members engage the grooves.

7. A method of controlling a position of elevator compensation rope members, the method comprising placing one of the compensation rope members within each of the spaces of the elevator compensation assembly of claim 1.

8. The elevator compensation assembly of claim 1, wherein the guard remains stationary relative to the compensation sheave.

9. An elevator compensation assembly, comprising:

a compensation sheave having an outer surface configured to engage a plurality of compensation rope members;

a guard having an inner surface situated adjacent and facing toward the outer surface of the compensation sheave, the guard remaining stationary relative to the compensation sheave; and a plurality of dividers that extend away from at least one of the outer surface of the compensation sheave or the inner surface of the guard, the dividers establishing a plurality of spaces between adjacent ones of the dividers for accommodating one of the plurality of compensation rope members in each of the spaces, wherein the dividers each comprise at least one of a rib on the inner surface of the guard or a groove on the inner surface of the guard.

10. The elevator compensation assembly of claim 9, wherein the plurality of compensation rope members do not contact the guard or the dividers when the plurality of compensation rope members engage the outer surface of the compensation sheave.

11. The elevator compensation assembly of claim 9, wherein the dividers each comprise a flange on the outer surface of the compensation sheave.

12. An elevator compensation assembly, comprising:

a compensation sheave having an outer surface configured to engage a plurality of compensation rope members;

a guard having an inner surface situated adjacent and facing toward the outer surface of the compensation sheave, the guard remaining stationary relative to the compensation sheave; and a plurality of dividers that extend away from at least one of the outer surface of the compensation sheave or the inner surface of the guard, the dividers establishing a plurality of spaces between adjacent ones of the dividers for accommodating one of the plurality of compensation rope members in each of the spaces, wherein:

the dividers each comprise a flange on the outer surface of the compensation sheave;

the outer surface of the compensation sheave includes a plurality of grooves;

the compensation rope members are respectively received in the grooves when the compensation rope members engage the outer surface of the compensation sheave;

the flanges are distinct from the grooves; and the compensation rope members do not contact the flanges when the compensation rope members engage the grooves.

* * * * *